US011753870B2

(12) United States Patent
Batarseh

(10) Patent No.: US 11,753,870 B2
(45) Date of Patent: Sep. 12, 2023

(54) DIRECTIONAL DRILLING TOOL

(71) Applicant: Saudi Arabian Oil Company, Dhahran (SA)

(72) Inventor: Sameeh Issa Batarseh, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 7 days.

(21) Appl. No.: 17/224,750

(22) Filed: Apr. 7, 2021

(65) Prior Publication Data

US 2022/0325583 A1 Oct. 13, 2022

(51) Int. Cl.
*E21B 7/04* (2006.01)
*E21B 47/002* (2012.01)
*E21B 43/119* (2006.01)

(52) U.S. Cl.
CPC ..... *E21B 7/04* (2013.01); *E21B 43/119* (2013.01); *E21B 47/002* (2020.05)

(58) Field of Classification Search
CPC ..... E21B 7/04; E21B 7/14; E21B 7/15; E21B 47/002
See application file for complete search history.

(56) References Cited

U.S. PATENT DOCUMENTS 6,755,262 B2 * 6/2004 Parker ..... B23K 26/40 175/57
6,851,488 B2 * 2/2005 Batarseh ..... E21B 7/14 175/11
6,888,097 B2 5/2005 Batarseh
7,147,064 B2 * 12/2006 Batarseh ..... B23K 26/142 175/11
8,627,901 B1 * 1/2014 Underwood ..... E21B 7/14 175/11
9,062,499 B2 * 6/2015 Braga ..... E21B 7/14
9,074,422 B2 * 7/2015 Grubb ..... B23K 26/1464
9,562,395 B2 * 2/2017 Grubb ..... E21B 7/14
9,664,012 B2 * 5/2017 Deutch ..... E21B 43/11
9,784,037 B2 * 10/2017 Grubb ..... B23K 26/1464
9,874,082 B2 * 1/2018 Tjhang ..... E21B 47/002
10,199,798 B2 * 2/2019 Faircloth ..... G02B 6/3624
11,180,957 B2 * 11/2021 Ramos ..... E21B 7/065
2003/0132029 A1 * 7/2003 Parker ..... E21B 7/15 175/11
2004/0195003 A1 * 10/2004 Batarseh ..... E21B 33/138 175/16
2005/0269132 A1 * 12/2005 Batarseh ..... E21B 7/15 175/40

(Continued)

FOREIGN PATENT DOCUMENTS

CN 203081295 U 7/2013
CN 203334954 U 12/2013

(Continued)

*Primary Examiner* — Jennifer H Gay
(74) *Attorney, Agent, or Firm* — Osha Bergman Watanabe & Burton LLP

(57) ABSTRACT

This application relates to systems and methods for directional drilling through hydrocarbon bearing formations using a downhole laser tool. The technologies can be used to steer or direct a drill bit or drill string to a new drilling direction in the formation through controlled activation of a laser beam discharged from a laser head mounted on a drill string or drill bit.

18 Claims, 4 Drawing Sheets

(56) References Cited

U.S. PATENT DOCUMENTS

2006/0102343 A1* 5/2006 Skinner ..... E21B 7/15 166/57
2010/0044106 A1* 2/2010 Zediker ..... E21B 29/00 166/65.1
2010/0078414 A1* 4/2010 Perry ..... B23K 26/382 175/11
2010/0206637 A1* 8/2010 Harrison ..... E21B 7/20 175/327
2011/0278270 A1* 11/2011 Braga ..... B28D 1/146 219/121.7
2012/0074110 A1* 3/2012 Zediker ..... E21B 10/60 219/121.72
2012/0255774 A1* 10/2012 Grubb ..... E21B 10/60 175/16
2012/0267168 A1* 10/2012 Grubb ..... B23K 26/0093 250/492.1
2014/0158425 A1* 6/2014 Bozso ..... E21B 7/14 175/16
2015/0167447 A1* 6/2015 Tjhang ..... E21B 47/18 348/85
2016/0084008 A1* 3/2016 Faircloth ..... B23K 26/146 175/16
2016/0186497 A1* 6/2016 Grubb ..... E21B 7/14 175/15
2017/0191314 A1* 7/2017 Faircloth ..... E21B 37/00
2019/0032434 A1* 1/2019 Batarseh ..... G02B 26/105
2020/0115962 A1* 4/2020 Batarseh ..... E21B 17/1078
2020/0131854 A1* 4/2020 Batarseh ..... E21B 7/06
2020/0173236 A1* 6/2020 Ramos ..... E21B 7/065
2022/0325583 A1* 10/2022 Batarseh ..... E21B 43/119

FOREIGN PATENT DOCUMENTS

GB 2565584 A * 2/2019 ..... E21B 10/60
WO WO-2019117869 A1 * 6/2019 ..... E21B 10/54
WO WO-2019117871 A1 * 6/2019 ..... B23K 26/0093

* cited by examiner

DIRECTIONAL DRILLING TOOL

TECHNICAL FIELD

This application relates to systems and methods for drilling through a rock formation.

BACKGROUND

Directional drilling refers to technologies for controlling the direction of a drilling tool or drill string along a trajectory. The directional drilling tool can be used to steer a drilling tool or drill bit to a desired depth at a desired horizontal displacement from the point of origin of the drilling operation. In some implementations, the directional drilling system allows for correction of drilling trajectory, or may be used to avoid subterranean obstacles. Directional drilling techniques may also be used to drill relief wells to an existing well, for example, to kill a blowout.

Systems and methods for directional drilling may include a whipstock system. A whipstock is a wedge-shaped or ramp-shaped tool that is lowered into an existing vertical wellbore. A drilling tool lowered into the wellbore is deflected by the ramp and thus steered into a lateral direction. Another technique is based on drill bits mounted on bent subs and driven by mud motors (motors driven by flowing mud) and. When the desired kick off point is reached, the drilling string must be pulled out and all drilling pipes must be disconnected to install the directional drilling assembly (FIG. 1). Such a directional drilling assembly includes a pipe 010 and bent sub 020. The bent sub acts like the pivot of a lever. The bent sub is connected to a motor 030, which rotates the bit and is pushed sideways as well as downwards. This sideways component of force at the bit gives the motor a tendency to drill a curved path, provided there is no rotation of the drill string or pipes 010.

SUMMARY

This specification describes technologies for drilling of a wellbore into a rock formation. The technologies can be used to steer or direct a drill bit or drill string to a new drilling direction in the formation through controlled activation of a laser beam mounted on a drill string or drill bit. The drill bit may be or may include a standard drill bit. The technologies described in this specification utilize the radiation provided by a laser to create a weak zone in the rock formation for the drill bit to follow because a drill bit tends to follow the path of least resistance and weakest rock in a formation. A high power laser as defined infra may be used for this purpose due to such a laser's precision, power output, and controllable function.

An example drilling tool is configured for use in a downhole environment of a wellbore within a hydrocarbon bearing formation. The tool includes a drill string for lowering and turning one or more drilling tools in the wellbore. The tool includes one or more optical transmission media. The one or more optical transmission media are part of an optical path originating at a laser generating unit configured to generate at least one raw laser beam. The one or more optical transmission media are configured for passing the at least one raw laser beam. The tool includes a bottom hole assembly at a distal end of the drill string. The bottom hole assembly includes a drill bit including a plurality of cutting elements for abrading or crushing rock. The bottom hole assembly includes a laser assembly including one or more laser heads. Each laser head is coupled to one of the one or more optical transmission media and configured for receiving at least one raw laser beam. Each laser head includes an optical assembly for altering at least one characteristic of a laser beam. Each laser head is configured to output an output laser beam to an area of a wall or floor of the wellbore adjacent to the drill bit.

The laser assembly may include four laser heads. Each laser head may include a purging assembly disposed at least partially within or adjacent to the laser head and configured for delivering a purging fluid to an area proximate each of the output laser beams. The laser assembly may be rotatable and the one or more laser heads may be rotationally moveable around a longitudinal axis of the bottom hole assembly or the drill string.

The tool may include a control system to control at least one of a motion, location, or orientation of the one or more laser heads or an operation of the optical assembly to direct the output laser beams within the wellbore. The optical assembly may include one or more lenses for manipulating the raw laser beam.

The one or more laser heads may include a rotational tip at a distal end of the laser head to control direction of an output laser beam. The one or more laser heads may include an acoustic sensor or a temperature sensor. The one or more laser heads may include a camera to image an area of the wellbore.

The tool may include an articulated joint configured to rotate the bottom hole assembly around an axis perpendicular to a longitudinal axis of the drill string.

An example method is performed within a wellbore of a hydrocarbon-bearing rock formation. The method includes lowering a drill string into the wellbore. The method includes turning a drilling tool disposed at a distal end of the drill string to abrade material to further extend the wellbore. The wellbore has a substantially circular cross-section. The method includes passing, through one or more optical transmission media, a raw laser beam generated by a laser generating unit at an origin of an optical path including the one or more optical transmission media. The method includes receiving, by a laser assembly including one or more laser heads coupled to the one or more optical transmission media, the raw laser beam and altering at least one characteristic of the raw laser beam for output to an first hydrocarbon-bearing rock formation. The method includes outputting, by the one or more laser heads, an output laser beam to a first area of a wall or floor of the wellbore adjacent to the drill bit thereby perforating or otherwise weakening a first section of the wellbore wall. The method includes continuing turning and lowering the drilling tool, thereby moving the drilling tool along a curved path in the direction of the first area.

The section of the wellbore wall may extend over less than half of a circumference of the wellbore wall. The method may include stopping the turning of the drilling tool prior to passing the raw laser beam. The method may include rotating the laser assembly around a longitudinal axis of the bottom hole assembly or the drill string.

The method may include outputting, by the one or more laser heads, the output laser beam to a second area of a wall or floor of the wellbore adjacent to the drill bit thereby perforating or otherwise weakening a second section of the wellbore wall. The method may include altering a location or an orientation of the one or more laser heads to direct the output laser beams within the wellbore.

The method may include purging a path of the laser beam using a purging nozzle while outputting the output laser beam. The method may include sweeping dust or vapor from a cover lens of the laser head using a fluid knife.

The method may include monitoring, using one or more sensors, one or more conditions in the wellbore and outputting signals based on the one or more conditions. The method may include imaging, using a camera, one or more areas of the wellbore.

DESCRIPTION OF THE DRAWINGS

In the drawings, like reference characters generally refer to the same parts throughout the different views. Also, the drawings are not necessarily to scale, emphasis instead generally being placed upon illustrating the principles of the disclosed systems and methods and are not intended as limiting. For purposes of clarity, not every component may be labeled in every drawing. In the following description, various embodiments are described with reference to the following drawings, in which.

DETAILED DESCRIPTION

This specification describes a laser-based system for directional drilling of a wellbore. Operation of conventional directional drilling systems, for example, systems including a downhole unit with a bent sub including a downhole motor to steer the drilling bit to the target, may be costly and time consuming: prior to insertion of a directional drilling system, the regular (straight) drill bit to be removed from the wellbore and detached from the drill string. A downhole unit of the conventional directional drilling system is then attached to the string and lowered downhole. The conventional directional drilling system is then activated to drill in a new (lateral) direction. After the lateral wellbore is initiated (for example, after less than 10 meters (m) are drilled in the new direction), the downhole unit is removed and the regular drill string is reinserted.

A system as described in this specification utilizes high power laser technology (as defined infra) combined with a conventional drilling bit system to provide directional drilling capabilities. The described technology may eliminate the need to replace a regular downhole unit with a directional drilling unit: the described system may include one or more lasers that are integrated into an otherwise standard bottom hole assembly and that are compact and light in weight. Such lasers may be installed on a drill pipes in close proximity (for example, directly adjacent) to the drilling bit so that the laser does not interfere with the regular operation of the drill bit. When directional drilling is required, one or more lasers may be activated to create holes or heat up a region in the rock formation, which reduces the strength and the mechanical properties of the formation. Because a drill bit may follow a path of least resistance when drilling through a rock formation, the drill may turn toward an area of such reduced strength and mechanical properties, thereby causing a change in drilling direction.

Figure 1:
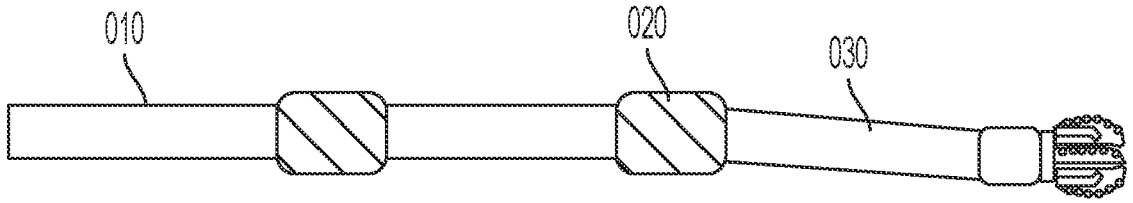
FIG. 1 is a schematic representation of directional drilling assembly.
Figure 2A:
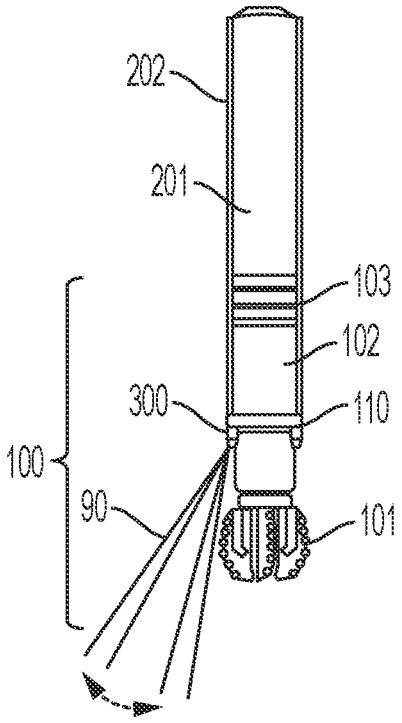
FIG. 2A is a schematic representation of an example drill string with a bottom hole assembly for directional drilling in accordance with one or more embodiments.

In some implementations, a system as described in this specification may include a bottom hole assembly (BHA) 100 disposed at a distal end of a drill string or drill pipe 201, for example, as shown in FIG. 2A.

A BHA 100 includes a drill bit, for example, a drill bit 101 that may be configured to operate within a wellbore of a hydrocarbon-bearing rock formation. The drill bit 101 may include a drill bit body, which includes at least one leg that is connectable to a drill string (for example, drill pipe 201) to connect the drill bit to a drilling rig (not shown). An example drilling rig may be configured to move the drill bit uphole or downhole, and to rotate the drill bit. In some implementations, drill pipe 201 may be rotated to turn the BHA 100 and the drill bit, for example, drill bit 101. In some implementations, a drill string may include a bottom hole assembly where the drill string remains stationary during drilling operation while the drill bit is rotated by a motor integrated into the bottom hole assembly. A drill bit 101 may include at least one roller cone connected to the drill bit body. The at least one roller cone includes a plurality of cutting elements for abrading or crushing rock. The at least one roller cone is rotatably mounted on the drill bit body. The drill bit may include at least one bearing mounted between a surface of the drill bit body and the at least one roller cone to facilitate rotation of the at least one roller cone. Alternatively or additionally, a drill bit to be used with the system described in this specification may include one or more stationary (for example, non-rotating) cutting elements for abrading or crushing rock.

In some implementations, a BHA 100 includes one or more hollow tube or pipes that constitute a main body of BHA 100. The BHA may include a (short) drilling collar 102 and a near bit stabilizer 103. The drilling collar 102 may provide weight on the drill bit 101. The near bit stabilizer 103 may include cutting or reaming implements and may improve quality of a drilled hole (for example, providing a straighter hole) compared to a system without stabilizer 103. BHA 100 may be connected to a drill pipe 201 such that BHA 100 may rotate or swing around an axis perpendicular to a longitudinal axis of drill pipe 201. In some implementations, BHA 100 may be hingedly connected to a drill pipe 201. In some implementations, BHA 100 may be connected to a drill pipe 201 via a pivot or an articulated joint (not shown). An articulated joint may have one, two, three, or more degrees of freedom. In some implementations, near bit stabilizer 103 or drilling collar 102 may include one or more articulated joints or hinges. In some implementations, near bit stabilizer 103 or drilling collar 102 may be connected to each other or connected to BHA 100 via one or more articulated joints or hinges. In some implementations, near bit stabilizer 103 or drilling collar 102 may be connected to each other or connected to drill pipe 201 via one or more articulated joints or hinges.

Figure 2B:
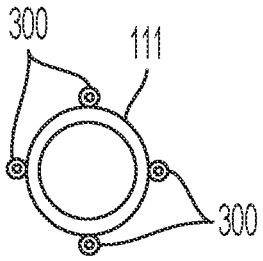
FIG. 2B is a schematic representation of an example laser ring including four laser heads in accordance with one or more embodiments.
Figure 3:
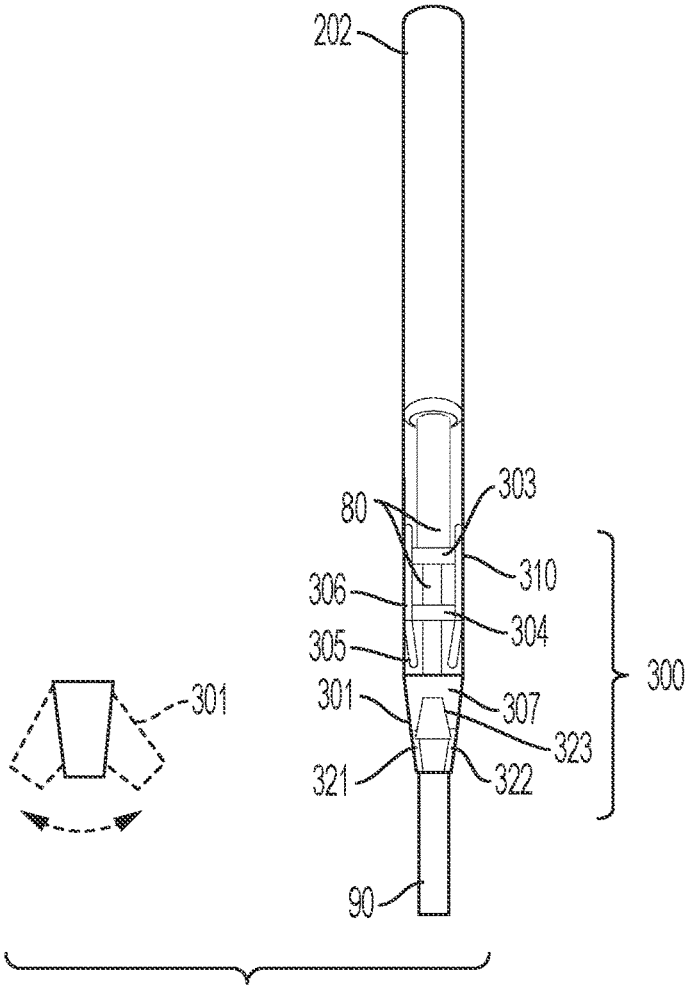
FIG. 3 is a schematic representation of an example laser head in accordance with one or more embodiments.

A BHA 100 includes a laser assembly 110 that may include one or more laser heads 300 coupled to one or more optical transmission media, for example, fiber optic cable 202, and configured for receiving at least one raw laser beam. In some implementations, a laser assembly 110 may be or may include a laser ring 111 including one, two, three, four, five, six or more laser heads 300 mounted on the laser ring 111. In some implementations, a laser assembly 110 may be or may include a laser ring 111 including four laser heads 300 mounted on the laser ring 111 (FIG. 2B). Laser ring 111 may be rotatably mounted on BHA 100 such that the laser heads 300 may be rotated around a longitudinal axis of BHA 100 or drill pipe 201. In some implementations, rotation of laser ring 111 may be achieved using one or more motors (for example, electric motors) coupled to an electronic control system. Rotation of laser ring 111 may be controlled to target different locations in a wellbore. An example laser head 300 is shown in FIG. 3. Each laser head 300 may include an optical assembly 310 for controlling at least one characteristic of a laser beam. Each laser head 300 is configured to receive a raw laser beam 80 and to output an output laser beam 90 to an area of the wellbore (immediately) adjacent to the drill bit. Raw laser beam 80 may be altered or otherwise transformed into output laser beam 90 using one or more elements of the system described here, for example, using one or more optical elements of laser head 300 or optical assembly 310.

A system as described in this specification includes a laser generating unit or generator (not shown). A laser generator is configured to generate a laser beam and to output the laser beam to one or more laser heads 300. In some implementations, a laser generator is at the surface near to a wellhead. In some implementations, a laser generator is downhole, in whole or in part. The laser beam output by laser generator is referred to as a raw laser beam, for example, raw laser beam 80, because it has not been manipulated by a laser head 300. Examples of a laser generator include ytterbium lasers, erbium lasers, neodymium lasers, dysprosium lasers, praseodymium lasers, and thulium lasers. In an example implementation, a laser generator is a high power laser, for example, a 5.34 kilowatt (kW) ytterbium-doped, multi-clad fiber laser.

In some implementations, a laser generator may be configured to output laser beams having different energy densities. Laser beams having different energy densities may be useful for rock formations that are composed of different materials having different sublimation points. For example, laser beams having different energy densities may be used to treat, for example, to sublimate, different types of rocks in a rock formation. In some implementations, the operation of a laser generator is programmable. For example, a laser generator may be programmed to vary the optical properties of the laser beam or the energy density of the laser beam.

In some implementations, the (raw) laser beam output by a laser generator (for example a raw laser beam 80) has an energy density that is sufficient to heat at least some rock, for example, to the sublimation point of the rock. In this regard, the energy density of a laser beam is a function of the average power output of the laser generator during laser beam output. In some implementations, the average power output of a laser generator is in one or more of the following ranges: between 500 Watts (W) and 1000 W, between 1000 W and 1500 W, between 1500 W and 2000 W, between 2000 W and 2500 W, between 2500 W and 3000 W, between 3000 W and 3500 W, between 3500 W and 4000 W, between 4000 W and 4500 W, between 4500 W and 5000 W, between 5000 W and 5500 W, between 5500 W and 6000 W, between 6000 W and 6500 W, or between 6500 W and 7000 W.

Figure 4:
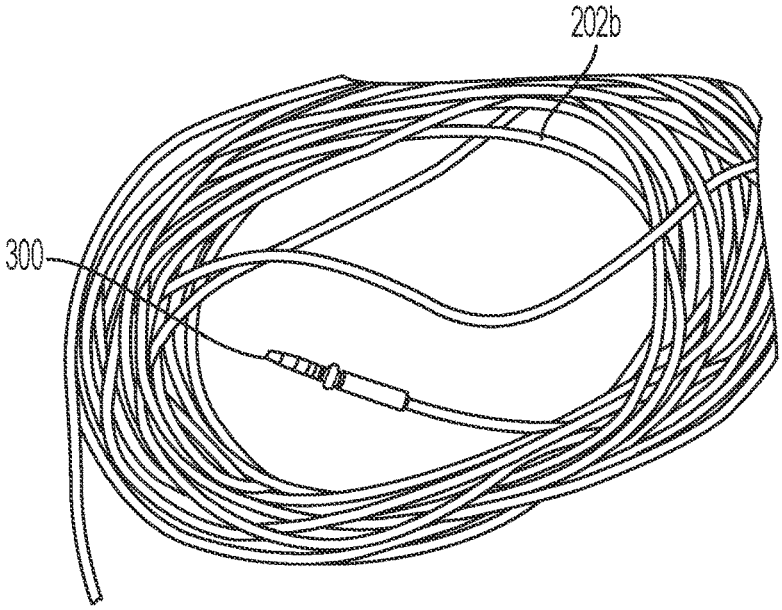
FIG. 4 is a pictorial representation of a flexible fiber optic cable attached to an example laser head in accordance with one or more embodiments.

A laser generator is part of an optical path that includes a laser head 300 and one or more optical transmission media. This optical path extends to optical assembly 310 of the laser head 300. An example of an optical transmission medium that may be used is fiber optic cable 202. Fiber optic cable 202 may include a single fiber optic strand, multiple fiber optic strands, or multiple fiber optic cables that are run downhole from a laser generator. In some implementations, a fiber optic cable with flexible casing can be used, such as fiber optic cable 202*b* depicted in FIG. 4. In some implementations, an outer diameter of a fiber optic cable 202 or 202*b* may be less than 1 centimeter (cm), less than 2 cm, less than 2.5 cm, less than 3 cm, or less than 5 cm. In some implementations, a fiber optic cable 202 or 202*b* may be attached to an exterior surface of drill pipe 201. A fiber optic cable 202 or 202*b* conducts the raw laser beam output by laser generator to a laser head 300. As described, the laser head may manipulate the laser beam, for example, raw laser beam 80, to change the geometry of the laser beam, the direction of the laser beam, or both. An output laser beam 90 output from the laser head 300 may penetrate downhole casings and cement to reach a rock formation. An output laser beam 90 output from the laser tool may penetrate one or more layers of rock of a rock formation. The system may be configured to minimize, or to reduce, power loss along the optical path. In some implementations, each output laser beam 90 has a power density or energy density (at the laser beam's target) that is 70% or more of the power density or energy density of the laser beam output by the laser generator.

The duration that a laser beam, for example, output laser beam 90, is applied to a rock in the formation may affect the extent to which the laser beam penetrates the rock. For example, the more time that the laser beam is applied to a particular location, the greater the penetration of the rock at that location may be.

In some implementations, a laser generator may be configured to operate in a run mode until a target penetration depth is reached. A run mode may include a cycling mode, a continuous mode, or both. During the continuous mode, a laser generator generates a laser beam continuously, for example, without interruption. In the continuous mode, a laser generator produces the laser beam until a target penetration depth is reached. During the cycling mode, a laser generator is cycled between being on and being off. In some implementations, a laser generator generates a laser beam during the on period. In some implementations, a laser generator does not generate a laser beam during the off period. In some implementations, a laser generator generates a laser beam during the off period, but the laser beam is interrupted before reaching laser head 300 downhole. For example, a laser beam may be safely diverted or the laser beam may be blocked from output. A laser generator may operate in the cycling mode to reduce the chances of one or more components of the system overheating, to clear a path of the laser beam, or both.

In the cycling mode, a duration of an on period can be the same as a duration of an off period. In the cycling mode, the duration of the on period can be greater than the duration of the off period, or the duration of the on period can be less than the duration of the off period. The duration of each on period and of each off period may be based on a target penetration depth. Other factors that may contribute to the duration of on periods and the duration of off periods include, for example, rock type, purging methods, laser beam diameter, and laser power.

The duration of each on period and of each off period may be determined by experimentation. Experiments on a sample of rock from a formation may be conducted prior to, or after, lowering the BHA 100 into the wellbore. Such experiments may be conducted to determine, for a cycling mode, optimal or improved durations of each on period and of each off period. Alternatively or additionally, the duration of each on period and of each off period may be determined by geological methods. For example, seismic data or subsurface maps of a rock formation may be analyzed and the duration may be based on the result of the analysis or analyses.

In some implementations, on periods and off periods can last between one and five seconds. In an example operation, the on period lasts for four seconds and the off period lasts for four seconds. Such operation may enable the laser beam (for example, output laser beam 90) to penetrate a rock formation comprised of berea sandstone to a depth of 30 centimeters (cm).

In this regard, the selection of a run mode may be based on a type of rock to penetrate and a target penetration depth. A rock formation that may require the laser generator to operate in the cycling mode includes, for example, sandstones having a large quartz content, such as berea sandstone. A rock formation that may require the laser generator to operate in the continuous mode includes, for example, limestone.

Target penetration depth may be determined based on a variety of factors, such as a type of material or rock in the formation, a maximum horizontal stress of material or rock in the formation, a compressive strength of material or rock in the formation, a desired penetration depth, or a combination of two or more of these features. In some examples, penetration depth is measured from the interior wall of the wellbore. Examples of penetration depths may be on the order of millimeters, centimeters, or meters. Examples of penetration depths may include penetration depths between 1 millimeter (mm) and 10 mm, penetration depths between 1 centimeter (cm) and 100 cm, and penetration depths between 1 meter (m) and 200 m.

A laser head 300 may include a first lens 303 and a cover lens 304. In some implementations, optical assembly 310 may include first lens 303 and cover lens 304. In operation, the raw laser beam 80 enters the laser head 300 via the first lens 303, which may focus, defocus, collimate, or otherwise alter or control one or more properties of the beam 80, for example, size and shape of the beam 80. In some implementations, fiber optic cable 202 is attached to first lens 303. In some implementations, fiber optic cable 202 is not attached to first lens 303. Cover lens 304 is positioned distal (with respect to the optical path originating at the laser generator) to the first lens and is adapted or configured to protect first lens 303 from debris or other environmental conditions downhole.

A laser head 300 (or, optical assembly 310) may include one or more fluid knives 305 or one or more nozzles, such as purging nozzles 306, or both one or more fluid knives 305 and one or more purging nozzles 306. In some implementations, an optical assembly 310 may include the one or more fluid knives 305 or the one or more nozzles, such as purging nozzles 306, or both one or more fluid knives 305 and one or more purging nozzles 306. Fluid knives 305 and purging nozzles 306 may be configured to operate together to reduce or to eliminate dust and vapor in the path of collimated laser beam. Dust or vapor in the path of laser the laser beam may disrupt, bend, or scatter the laser beam.

A fluid knife 305 may be configured to sweep dust or vapor from cover lens 304. In some implementations, fluid knife 305 is proximate to cover lens 304 and is configured to discharge a fluid or a gas onto, or across, a surface cover lens 304. Examples of gas that may be used include air and nitrogen. In some implementations, the combined operation of fluid knives 305 and purging nozzles 306 can create an unobstructed path for transmission of a laser beam from cover lens 304 to a surface of a wellbore or rock formation.

In this regard, purging nozzles 306 may be configured to clear a path between cover lens 304 and a hydrocarbon-bearing rock formation by discharging a purging medium on or near a laser muzzle 307. The choice of purging media to use, such as liquid or gas, may be based on the type or rock in the formation and the pressure of a reservoir associated with the formation. In some implementations, the purging media may be, or include, a non-reactive, non-damaging gas such as nitrogen. A gas purging medium may be appropriate when fluid pressure in the wellbore is small, for example, less than 50000 kilopascals, less than 25000 kilopascals, less than 10000 kilopascals, less than 5000 kilopascals, less than 2500 kilopascals, less than 1000 kilopascals, or less than 500 kilopascals. In some implementations, purging nozzles 306 lie flush inside of laser head 300 so as not to obstruct the path of a laser beam. In some implementations, purging may be cyclical. For example, purging may occur while a laser beam is on.

Dust or vapor may be created by sublimation of the rock, as described. In some implementations, a laser head 300 may include one or more vacuum nozzles (not shown) that may be configured to aspirate or to vacuum such dust or vapor from an area surrounding laser muzzle 307. The dust or vapor may be sent to the surface and analyzed. The dust or vapor may be analyzed to determine a type of the rock and fluids contained in the rock. The vacuum nozzles may be positioned flush with the laser muzzle 307. The vacuum nozzles may include one, two, three, four, or more nozzles depending, for example, on the quantity of dust and vapor. The size of vacuum nozzles may depend, for example, on the volume of dust or vapor to be removed and the physical requirements of the system to transport the dust to the surface. Vacuum nozzles may operate cyclically or continuously.

A laser head 300 may include one or more sensors to monitor one or more environmental conditions in the wellbore, one or more conditions of the drill string, or both environmental conditions and conditions of the string. Example sensors include one or more temperature sensors 321 or one or more acoustic sensors 322. Such sensors may be attached to, or integrated into, laser head 300. In some implementations, sensors, for example, temperature sensor 321, may be configured to monitor temperature in the wellbore or surface temperature of laser head 300. In some implementation, one or more acoustic sensors 322 maybe be configured to monitor noise in the wellbore. In some implementations, sensors may include one or more acoustic sensors, or one or more pressure sensors, one or more strain sensors, or some combination of these or other sensors. In some implementations, sensors of a laser head 300 may be configured to measure mechanical stress in a wall of the wellbore, mechanical stress in laser head 300, a flow of fluids in the wellbore, fluid pressure in the wellbore, radiation in the wellbore, a presence of debris in the wellbore, or magnetic fields in the wellbore, or a combination of two or more of these conditions. In some implementations, laser head 300 includes one or more optical sensors or one or more cameras 323 connected to a video display system uphole to monitor one or more downhole conditions.

In an example implementation, laser head 300 may include at least one temperature sensor 321. The temperature sensor may be configured to measure a temperate at its current location and to output signals representing that temperature. The signals may be output to a computing system located on the surface. In response to signals received from the temperature sensor, the computing system may control operation of the system. For example, if the signals indicate that the temperature downhole is great enough to cause damage to downhole equipment, the computing system may instruct that action be taken. For example, all or some downhole equipment, including the BHA 100, may be extracted from the well. In some implementations, data collected from the temperature sensor can be used to monitor the intensity of output laser beam 90. Such measurements may be used to adjust the beam energy.

In some implementations, the signals may indicate a temperature that exceeds a set point that has been established for the BHA 100 or downhole equipment. For example, the set point may represent a maximum temperature that the laser tool can withstand without overheating. If the set point is reached, the laser system may be shut-down. The value of the set point may vary based on type of laser being used or the materials used for the manufacture of the BHA 100, for example. Examples of set points include 1000° Celsius (C), 1200° C., 1400° C., 1600° C., 1800° C., 2000° C., 2500° C., 3000° C., 3500° C., 4000° C., 4500° C., 5000° C., 5500° C., and 6000° C. In an example implementation, the set point is between 1425° C. and 1450° C.

A laser head 300 may include a rotational tip 301 at a distal end of the laser head 300 to control direction or orientation of an output laser beam 90. In some implementations, a rotational tip 301 may include one or more optical elements (for example, one or more mirrors, lenses, or prisms) to control or direct a laser beam. In some implementations, a rotational tip 301 may be connected to a body of laser head 300 via one or more hinges, pivots, or articulated joints (not shown). An articulated joint may have one, two, three, or more degrees of freedom. The one or more optical elements of rotational tip 301 or the entire rotational tip 301 may be moveable about one, two, or more axes. Rotating or pivoting motion may be controlled by one or more mechanical actuators (for example, one or more electric motors) connected to a power supply and controlled by an electronic control unit at the surface. In some implementations, direction of the output laser beam 90 may be altered during operation of the laser. In some implementations, direction of the output laser beam 90 may be altered during operation of the drill bit 101.

Figure 5:
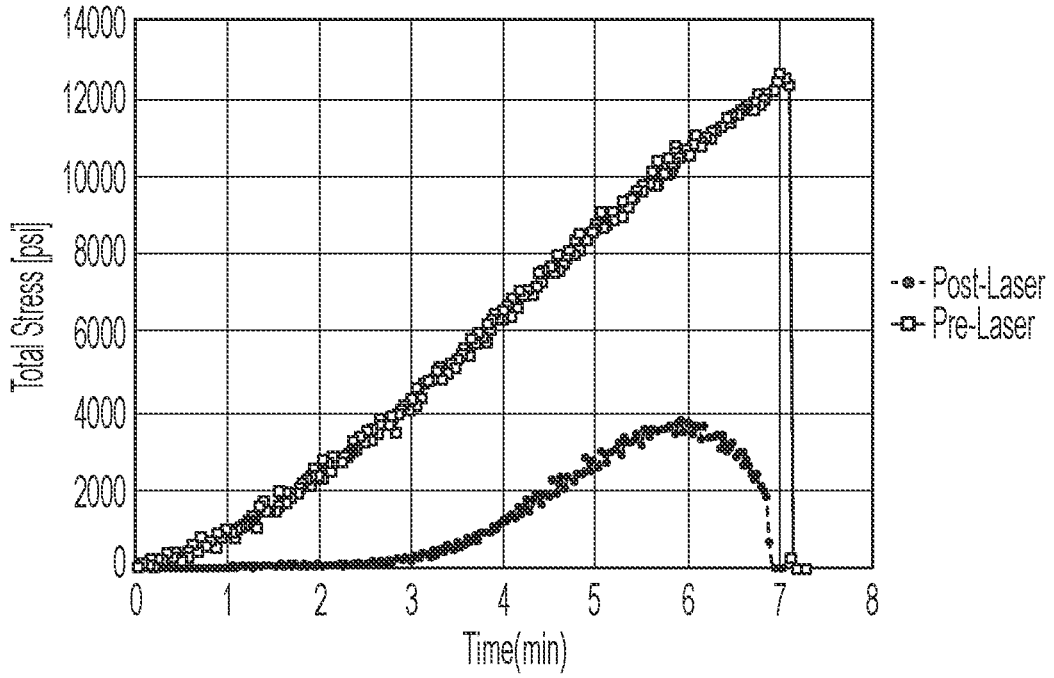
FIG. 5 is a graph representation illustrating the results of a uniaxial stress test of a limestone rock sample pre- and post-laser treatment using a uniaxial stress measurement device.

In some implementations, a laser beam, for example, output laser beam 90, may be used to create holes or other perforations in a rock formation, for example, by sublimating material in the rock formation. Such holes or perforations may structurally disrupt or weaken a region in the rock formation. In some implementations, the holes may have a diameter of between about 0.5 cm and about 20 cm, between about 1 cm and 15 cm, between about 2 cm and 10 cm, or between about 3 cm and 8 cm. In some implementations, a laser beam, for example, output laser beam 90, may be used to heat up a region in a rock formation. Heating rock may reduce structural integrity or otherwise reduce mechanical strength of the formation. The effect of laser treatment of rock was evaluated in a laboratory experiment. FIG. 5 shows the results of a uniaxial stress test of a limestone rock sample pre- and post-laser treatment using a uniaxial stress measurement device. Pre-laser treatment, the rock sample broke at 12300 pounds per square inch (psi). A sample exposed to laser treatment exhibited reduced strength or stress resistance: the rock sample broke under stress at 3800 psi. As mentioned, a drill bit tends to follow the area of least resistance in a rock. Without wishing to be bound by theory, given that in this example the mechanical strength of the rock was reduced by a factor of four, a drill bit turning in a wellbore with a laser treated region as described would likely follow the path of least resistance and alter direction toward or through the weakened region.

Figure 6:
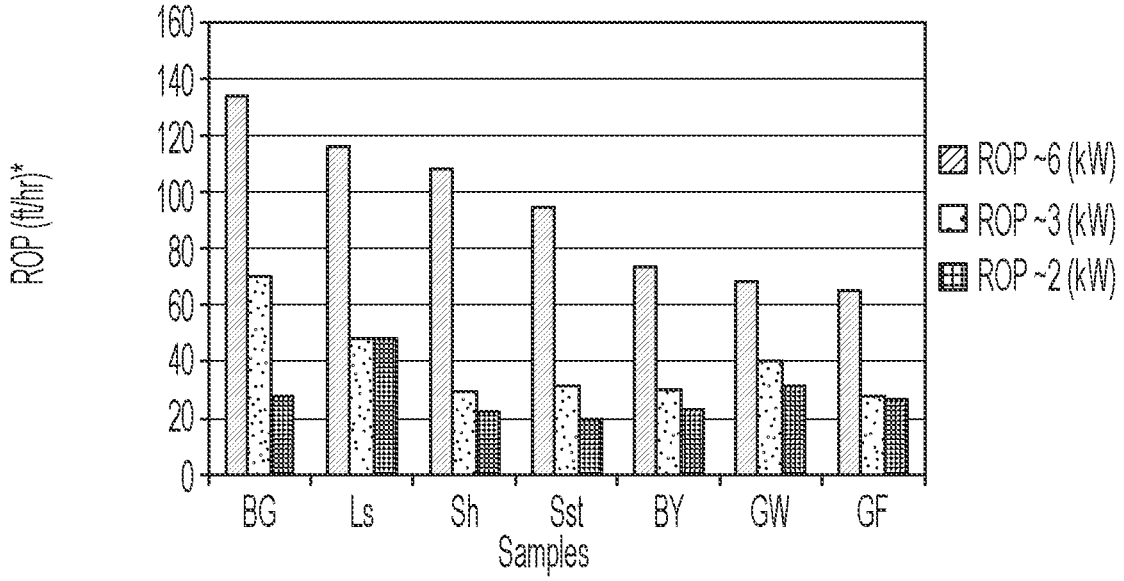
FIG. 6 is a graphical representation illustrating the results of the use of a laser head with a selection on minerals in accordance with one or more embodiments.

One advantage of using high power laser technology is the ability to create controlled non-damaged, clean holes for various types of the rock. The laser head disclosed in this specification may have the capability to penetrate in many types of rocks having various rock strengths and stress orientations, as shown in the graph of FIG. 6. The graph represents the Rate of Penetration (ROP) in feet per hour (ft/hr) for a variety of materials, where BG and BY=Brea Gray, Ls=limestone, Sh=shale, Sst=sandstone, and GW and GF=granite. The laser strengths used were at 2 kW, 3 kW, and 6 kW power.

Figure 7A:
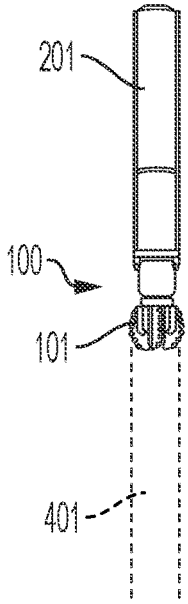
FIG. 7A-7D are schematic representations of an example operation of a bottom hole assembly for directional drilling in accordance with one or more embodiments.
Figure 7B:
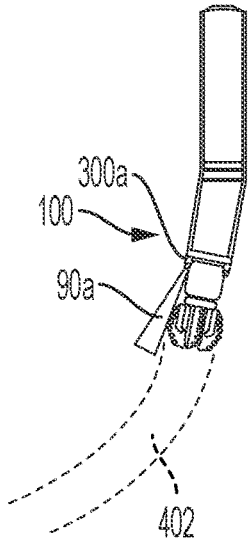
Figure 7C:
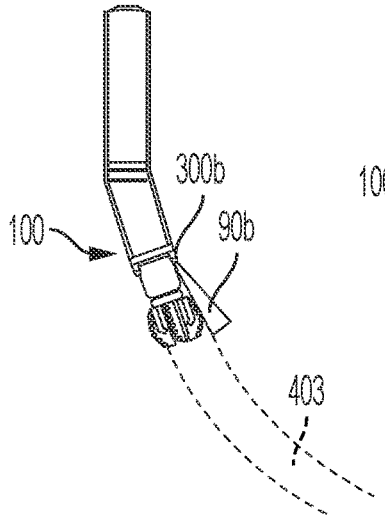
Figure 7D:
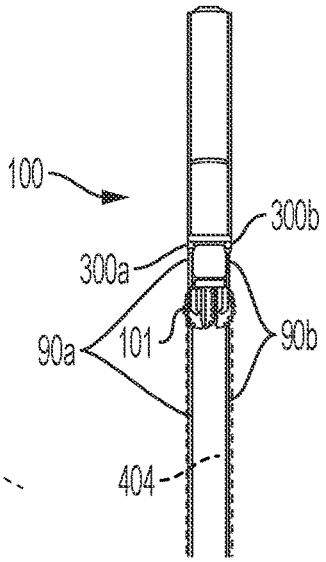

An example operation of a system including a BHA 100 is illustrated in FIGS. 7A-C. Initially, an example BHA 100 mounted on a distal end of drill pipe 201 is used to drill a cylindrical wellbore following a substantially straight path 401 (FIG. 7A). Am output laser beam 90*a* may be discharged from a first laser head 300*a*, which may cause weakening of a first area in a wall or floor (or both) of the wellbore substantially distal or lateral to laser head 300*a*. The first area may be distal or lateral (or both) of drill bit 101. In some implementations, a first area may extend over less than 50% of the circumference of the cylindrical wellbore. In some implementations, a (first) area may extend over less than 25% of the circumference of a cylindrical wellbore. In some implementations, a (first) area may extend over between 5% and 50% of the circumference of a cylindrical wellbore. In some implementations, a (first) area may extend over between 5% and 90% of the circumference of a cylindrical wellbore. Weakening of said first area may cause the drill bit 101 to divert and follow a path of least resistance toward said first area, thereby causing the BHA 100 to follow a first curved path 402 (FIG. 7B). A second output laser beam 90*b* may be discharged from a second laser head 300*b*, which may cause weakening of a second area substantially distal to laser head 300*b*. Weakening of said second area may cause the drill bit 101 to divert and follow a path of least resistance toward said second area, thereby causing the BHA 100 to follow a second curved path 403 (FIG. 7C). In some implementations, first laser head 300*a* may be mounted on a laser ring 111. Laser head 300*a* may be in first position to discharge a first laser beam 90*a* and may subsequently rotated to a second position to discharge second laser beam 90*b*. In some implementations, two or more laser heads 300 may each discharge a laser beam 90 contemporaneously. In some example embodiments, first laser head 300*a* and second laser head 300*b* may discharge output laser beams 90*a* and 90*b*, respectively, contemporaneously. This parallel discharge of two output laser beams may weaken the material in the formation (for example, distal to the drill bit 101), which may help direct the drilling bit 101 to drill along a more uniform and straight path 404.

Figure 8:
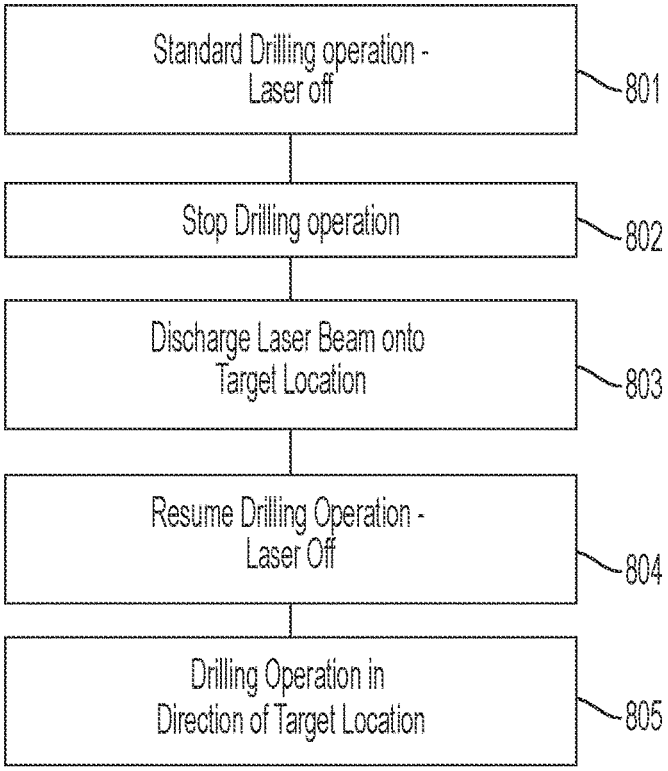
FIG. 8 is a flow chart illustrating an example operation of a system as described in the present specification.

An example work flow is shown in a diagram in FIG. 8. Initially, at step 801, standard drilling is performed in an initial direction (for example, on a substantially straight path) of a wellbore. Drilling operation is then stopped (step 802). Optionally, a laser head (for example, laser head 300) is then rotated into a desired position. At step 803, a laser beam is discharged from a laser head onto a target location inside the wellbore. The laser beam is then turned off and drilling operation is resumed (step 804). Standard drilling operation may continue in the direction of the target location (step 805).

At least part of the system described in this specification and its various modifications may be controlled by a computer program product, such as a computer program tangibly embodied in one or more information formation carriers. Information carriers include one or more tangible machine-readable storage media. The computer program product may be executed by a data processing apparatus. A data processing apparatus can be a programmable processor, a computer, or multiple computers.

A computer program may be written in any form of programming language, including compiled or interpreted languages. It may be deployed in any form, including as a stand-alone program or as a module, component, subroutine, or other unit suitable for use in a computing environment. A computer program may be deployed to be executed on one computer or on multiple computers. The one computer or multiple computers can be at one site or distributed across multiple sites and interconnected by a network.

Actions associated with implementing the systems may be performed by one or more programmable processors executing one or more computer programs. All or part of the systems may be implemented as special purpose logic circuitry, for example, a field programmable gate array (FPGA) or an ASIC application-specific integrated circuit (ASIC), or both.

Processors suitable for the execution of a computer program include, for example, both general and special purpose microprocessors, and include any one or more processors of any kind of digital computer. Generally, a processor will receive instructions and data from a read-only storage area or a random access storage area, or both. Components of a computer (including a server) include one or more processors for executing instructions and one or more storage area devices for storing instructions and data. Generally, a computer will also include one or more machine-readable storage media, or will be operatively coupled to receive data from, or transfer data to, or both, one or more machine-readable storage media. Machine-readable storage media include mass storage devices for storing data, for example, magnetic, magneto-optical disks, or optical disks. Non-transitory machine-readable storage media suitable for embodying computer program instructions and data include all forms of non-volatile storage area. Non-transitory machine-readable storage media include, for example, semiconductor storage area devices, for example, erasable programmable read-only memory (EPROM), electrically erasable programmable read-only memory (EEPROM), and flash storage area devices. Non-transitory machine-readable storage media include, for example, magnetic disks, for example, internal hard disks or removable disks, magneto-optical disks, and CD-ROM and DVD-ROM disks.

Each computing device may include a hard drive for storing data and computer programs, a processing device (for example, a microprocessor), and memory (for example, RAM) for executing computer programs.

Throughout the description, where compositions, compounds, or products are described as having, including, or comprising specific components, or where processes and methods are described as having, including, or comprising specific steps, it is contemplated that, additionally, there are articles, devices, and systems of the present application that consist essentially of, or consist of, the recited components, and that there are processes and methods according to the present application that consist essentially of, or consist of, the recited processing steps.

It should be understood that the order of steps or order for performing certain actions is immaterial, so long as the described method remains operable. Moreover, two or more steps or actions may be conducted simultaneously.

What is claimed is:

1. A drilling tool configured for use in a downhole environment of a wellbore within a hydrocarbon bearing formation, the tool comprising:

a drill string having a distal end attached to a bottom hole assembly, wherein the drill string lowers and turns at least one or more elements of the bottom hole assembly;

the bottom hole assembly comprising:

one or more optical transmission media, the one or more optical transmission media being part of an optical path originating at a laser generating unit configured to generate at least one raw laser beam, the one or more optical transmission media configured for passing the at least one raw laser beam; and a laser assembly comprising one or more laser heads, each laser head coupled to one of the one or more optical transmission media and configured for receiving at least one raw laser beam, each laser head comprising an optical assembly for altering at least one characteristic of a laser beam, where each laser head is configured to output an output laser beam to an area of a wall or floor of the wellbore adjacent to a the drill bit to create a path of least resistance to direct the drill bit to change a drilling direction; and a rotational tip at a distal end of the laser head configured to control a direction or orientation of the output laser beam; and the drill bit comprising a plurality of cutting elements for abrading or crushing rock, wherein the drill bit follows the path of least resistance in the wellbore; and wherein the one or more laser heads further comprise a stress sensor configured to measure mechanical stress in a wall of the wellbore.

2. The tool of claim 1, where the laser assembly comprises four laser heads.

3. The tool of claim 1, where each laser head comprises a purging assembly disposed at least partially within or adjacent to the laser head and configured for delivering a purging fluid to an area proximate each of the output laser beams.

4. The tool of claim 1, where the laser assembly is rotatable and the one or more laser heads are rotationally moveable around a longitudinal axis of the bottom hole assembly or the drill string.

5. The tool of claim 1, comprising a control system to control at least one of a motion, location, or orientation of the one or more laser heads or an operation of the optical assembly to direct the output laser beams within the wellbore.

6. The tool of claim 1, where the optical assembly comprises one or more lenses for manipulating the raw laser beam, wherein manipulating the raw laser beam comprises reflecting or redirecting the raw laser beam to an area lateral of the drill bit.

7. The tool of claim 1, wherein the drill bit is stationary or rotating during the passing of the raw laser beam and wherein the output of the output laser beam by each of the one or more laser heads to an area of the wall or floor of the wellbore adjacent to the drill bit further comprises a first output laser beam output by at least one of the laser heads to a side of the wall of the wellbore and a second output laser beam output by at least another one of the laser heads directed to an opposite side of the wall of the wellbore contemporaneously.

8. The tool of claim 1, wherein the stress sensor is coupled to an electronic control unit at a surface location configured to output signals based on the mechanical stress in the wall of the wellbore.

9. The tool of claim 1, comprising an articulated joint configured to rotate the bottom hole assembly around an axis perpendicular to a longitudinal axis of the drill string.

10. A method performed within a wellbore of a hydrocarbon-bearing rock formation, the method comprising:

lowering a drilling tool into the wellbore, wherein the drilling tool comprises a drill string having a distal end attached to a bottom hole assembly;

turning at least one or more elements of the bottom hole assembly including a drill bit to abrade material to further extend the wellbore, the wellbore having a substantially circular cross-section;

passing, through one or more optical transmission media, a raw laser beam generated by a laser generating unit at an origin of an optical path comprising the one or more optical transmission media, receiving, by a laser assembly comprising one or more laser heads coupled to the one or more optical transmission media, the raw laser beam and altering at least one characteristic of the raw laser beam for output to a first hydrocarbon-bearing rock formation, outputting, by the one or more laser heads, an output laser beam to a first area of a wall or floor of the wellbore adjacent to the drill bit thereby perforating or otherwise creating a path of least resistance in a first section of the wellbore wall, wherein outputting the output laser beam comprises using a rotational tip at a distal end of the laser head to control a direction or orientation of the output laser beam;

continuing turning and lowering the drilling tool, thereby moving the drilling tool along a curved path in the direction of the path of least resistance in the first section without using any of a directional drilling assembly; and determining a mechanical stress in a wall of the wellbore using a stress sensor.

11. The method of claim 10, wherein the first section of the wellbore wall extends over less than half the circumference of the wellbore wall.

12. The method of claim 10, comprising continuing the turning of the drilling tool while passing the raw laser beam.

13. The method of claim 10, comprising rotating the laser assembly around a longitudinal axis of the bottom hole assembly or the drill string.

14. The method of claim 13, comprising outputting, by the one or more laser heads, the output laser beam to a second area of a wall or floor of the wellbore adjacent to the drill bit thereby perforating or otherwise weakening a second section of the wellbore wall.

15. The method of claim 10, comprising altering a location or an orientation of the one or more laser heads to direct the output laser beams within the wellbore.

16. The method of claim 10, comprising purging a path of the laser beam using a purging nozzle while outputting the output laser beam.

17. The method of claim 10, comprising sweeping dust or vapor from a cover lens of the laser head using a fluid knife.

18. The method of claim 10, wherein the stress sensor is coupled to an electronic control unit at a surface location configured to output signals based on the mechanical stress in the wall of the wellbore.

* * * * *